US007614169B2

(12) United States Patent
Calvano et al.

(10) Patent No.: US 7,614,169 B2
(45) Date of Patent: Nov. 10, 2009

(54) METHOD OF MANUFACTURING AN ARTICLE OF FOOTWEAR

(75) Inventors: Michael A. Calvano, Tualatin, OR (US); Randall Wyszynski, Lake Oswego, OR (US); Michael Hui, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 17 days.

(21) Appl. No.: 12/198,376

(22) Filed: Aug. 26, 2008

(65) Prior Publication Data

US 2008/0313824 A1 Dec. 25, 2008

Related U.S. Application Data

(62) Division of application No. 11/204,768, filed on Aug. 16, 2005, now Pat. No. 7,497,033.

(51) Int. Cl.
*A43B 1/10* (2006.01)

(52) U.S. Cl. ..... 36/145; 12/142 T; 36/102

(58) Field of Classification Search ..... 12/145, 12/142 T, 142 RS, 146 B; 36/102, 31, 28, 36/25 R, 30 R, 103
See application file for complete search history.

(56) References Cited

U.S. PATENT DOCUMENTS

| | | | | | |
|---|---|---|---|---|---|
| 2,361,511 | A * | 10/1944 | Stritter | 36/31 |
| 2,518,547 | A * | 8/1950 | Hill | 36/19.5 |
| 3,972,087 | A * | 8/1976 | Haizinger | 12/145 |
| 4,794,707 | A * | 1/1989 | Franklin et al. | 36/107 |
| 4,924,606 | A * | 5/1990 | Montgomery et al. | 36/31 |
| 6,321,469 | B1 * | 11/2001 | Cretinon | 36/102 |
| 7,121,020 | B1 * | 10/2006 | Bathum | 36/102 |
| 7,178,271 | B2 * | 2/2007 | Covatch | 36/102 |
| 2001/0001904 | A1 * | 5/2001 | Hernadez | 36/28 |

* cited by examiner

*Primary Examiner*—Ted Kavanaugh
(74) *Attorney, Agent, or Firm*—Banner & Witcoff, Ltd.

(57) ABSTRACT

A method of forming an article of footwear includes the steps of providing an upper having a forefoot portion, a midfoot portion, a heel portion, and a pocket positioned beneath the forefoot portion; placing the upper on a last; inserting a first midsole portion into the pocket; and securing an outsole assembly to the upper, the outsole assembly comprising a second midsole portion and an outsole secured to a lower surface of the second midsole portion. The second midsole portion and the outsole are visible from an exterior of the article of footwear and the first midsole portion is not visible from an exterior of the article of footwear.

12 Claims, 2 Drawing Sheets

METHOD OF MANUFACTURING AN ARTICLE OF FOOTWEAR

This application is a divisional of application Ser. No. 11/204,768, filed on Aug. 16, 2005, which is incorporated herein by reference in its entirety

FIELD OF THE INVENTION

This invention relates generally to an article of footwear, and, in particular, to an article of footwear and a method of manufacturing the same.

BACKGROUND OF THE INVENTION

A conventional article of athletic footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces (i.e., imparting cushioning), the sole structure may provide traction and control foot motions, such as pronation. Accordingly, the upper and the sole structure operate cooperatively to provide a comfortable structure that is suited for a variety of ambulatory activities, such as walking and running.

The sole structure of athletic footwear generally exhibits a layered configuration that includes a comfort-enhancing insole, a resilient midsole formed from a polymer foam material, and a ground-contacting outsole that provides both abrasion-resistance and traction. The midsole is the primary sole structure element that imparts cushioning and controls foot motions. Suitable polymer foam materials for the midsole include ethylvinylacetate or polyurethane that compress resiliently under an applied load to attenuate ground reaction forces. Conventional polymer foam materials are resiliently compressible, in part, due to the inclusion of a plurality of open or closed cells that define an inner volume substantially displaced by gas. The polymer foam materials of the midsole may also absorb energy when compressed during ambulatory activities.

In double lasted footwear, a portion of the midsole is surrounded by the upper and, therefore, is not visible from an exterior of the article of footwear. During the manufacture of known double lasted footwear, the footwear is initially passed through the lasting line, where the upper is secured to a stroebel sock, with a portion of the upper wrapped about an exterior of at least a portion of the midsole. The upper is then passed through the lasting line again at which point the outsole and the remainder of the midsole are secured to the exterior surface of the upper.

It would be desirable to provide an article of footwear that reduces or overcomes some or all of the difficulties inherent in prior known devices. Particular objects and advantages will be apparent to those skilled in the art, that is, those who are knowledgeable or experienced in this field of technology, in view of the following disclosure of the invention and of certain embodiments.

SUMMARY

The principles of the invention may be used to advantage to provide an article of footwear with improved flexibility, fit, comfort and performance. In accordance with a first aspect, an article of footwear includes an upper having a forefoot portion, a midfoot portion, a heel portion, and a pocket positioned beneath the forefoot portion. A first midsole portion is received in the pocket.

An outer sole assembly is secured to the upper. The outer sole assembly is visible from an exterior of the article of footwear and the first midsole portion is not visible from an exterior of the article of footwear.

In accordance with another aspect, an article of footwear includes a stroebel sock and an upper secured to the stroebel sock. The upper has a forefoot portion, a midfoot portion, a heel portion, and a pocket positioned beneath the forefoot portion. A first midsole portion is received in the pocket. An outsole assembly is secured to the upper. The outsole assembly includes a second midsole portion and an outsole secured to a lower surface of the second midsole portion. The second midsole portion and the outsole are visible from an exterior of the article of footwear and the first midsole portion is not visible from an exterior of the article of footwear.

In accordance with yet another aspect, an article of footwear includes an upper having a forefoot portion, a midfoot portion, a heel portion, and a pocket positioned beneath the forefoot portion. A midsole portion has a forefoot portion, a midfoot portion and a heel portion. The forefoot portion is received in the pocket, and the midfoot and heel portions are secured to the upper. An outsole is secured to the midsole portion. The outsole and the heel portion of the midsole portion are visible from an exterior of the article of footwear and the forefoot portion of the midsole portion is not visible from an exterior of the article of footwear.

In accordance with a further aspect, an article of footwear includes a stroebel sock and an upper secured to the stroebel sock, the upper having a forefoot portion, a midfoot portion, and a heel portion. A pocket is positioned beneath the forefoot portion and includes a lateral wing extending downwardly from the upper, a medial wing extending downwardly from the upper, and a strap secured at opposed ends thereof to the lateral wing and the medial wing. A first midsole portion is received in the pocket. An outsole assembly is secured to a lower surface of the upper. The outsole assembly includes a second midsole portion and an outsole secured to a lower surface of the second midsole portion. The second midsole portion and the outsole are visible from an exterior of the article of footwear and the first midsole portion is not visible from an exterior of the article of footwear.

In accordance with yet another aspect, a method of forming an article of footwear includes the steps of providing an upper having a forefoot portion, a midfoot portion, a heel portion, and a pocket positioned beneath the forefoot portion; placing the upper on a last; inserting a first midsole portion into the pocket; and securing an outsole assembly to the upper. The outsole assembly includes a second midsole portion and an outsole secured to a lower surface of the second midsole portion. The second midsole portion and the outsole are visible from an exterior of the article of footwear and the first midsole portion is not visible from an exterior of the article of footwear.

In accordance with yet a further aspect, an article of footwear is formed by the steps of placing an upper on a last, with the upper having a forefoot portion, a midfoot portion, a heel portion, and a pocket positioned beneath the forefoot portion; inserting a first midsole portion into the pocket; and securing an outsole assembly to the upper. The outsole assembly includes a second midsole portion and an outsole secured to a lower surface of the second midsole portion. The second midsole portion and the outsole are visible from an exterior of the article of footwear and the first midsole portion is not visible from an exterior of the article of footwear.

Substantial advantage is achieved by providing an article of footwear with a pocket to receive a first midsole portion. In particular, certain embodiments of the article of footwear can provide improved flexibility. These and additional features and advantages disclosed here will be further understood from the following detailed disclosure of certain embodiments.

Figure 1:
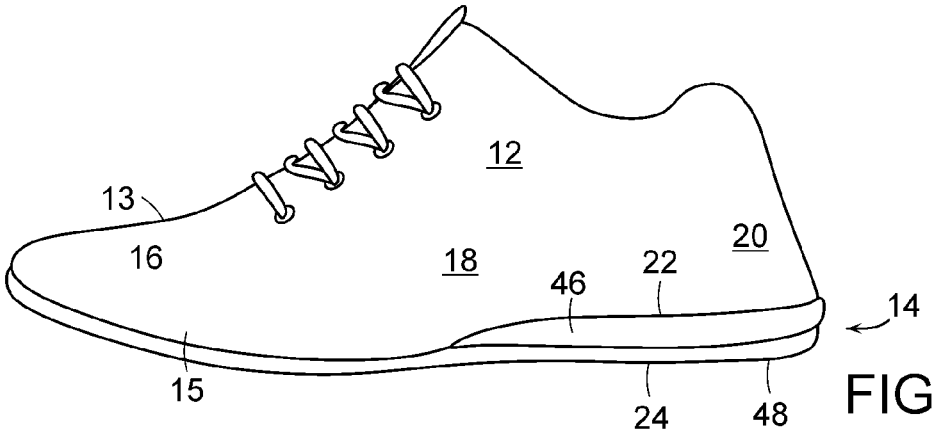
FIG. 1 is a perspective view of an embodiment of a article of footwear.

The figures referred to above are not drawn necessarily to scale and should be understood to provide a representation of the invention, illustrative of the principles involved. Some features of the footwear depicted in the drawings have been enlarged or distorted relative to others to facilitate explanation and understanding. The same reference numbers are used in the drawings for similar or identical components and features shown in various alternative embodiments. Footwear as disclosed herein would have configurations and components determined, in part, by the intended application and environment in which they are used.

DETAILED DESCRIPTION OF CERTAIN PREFERRED EMBODIMENTS

The present invention may be embodied in various forms. A preferred embodiment of an article of footwear 10 is shown in FIG. 1. Footwear 10 includes an upper 12 and a sole assembly 14 secured to upper 12. Footwear 10 has a medial, or inner, side 13 and a lateral, or outer, side 15. For purposes of general reference, footwear 10 may be divided into three general portions: a forefoot portion 16, a midfoot portion 18, and a heel portion 20. Portions 16, 18, and 20 are not intended to demarcate precise areas of footwear 10. Rather, portions 16, 18, and 20 are intended to represent general areas of footwear 10 that provide a frame of reference during the following discussion.

Unless otherwise stated, or otherwise clear from the context below, directional terms used herein, such as rearwardly, forwardly, beneath, rear, front, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the right as seen in FIG. 1. Naturally, forwardly is toward forefoot portion 16, that is, to the left as seen in FIG. 1, and downwardly is toward the bottom of the page as seen in FIG. 1. Inwardly is toward the center of footwear 10, and outwardly is toward the outer peripheral edge of footwear 10.

Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 may include an insole (not shown) located within upper 12, a midsole 22, and an outsole 24. Midsole 22 is positioned beneath upper 12 and functions as the primary shock-attenuating and energy-absorbing component of footwear 10. Midsole 22 may be secured to upper 12 by adhesive or other suitable means. Suitable materials for midsole 22 include polymer foam materials such as ethylvinylacetate or polyurethane, or any other material that compresses resiliently.

Outsole 24 is positioned beneath midsole 22 and may be secured to midsole 22 by adhesive or other suitable means. Suitable materials for outsole 24 include polymers, e.g., polyether-block co-polyamide polymers (sold as Pebax® by ATOFINA Chemicals of Philadelphia, Pa.), and nylon resins such as Zytel®, sold by Dupont. Other suitable materials for outsole 24 will become readily apparent to those skilled in the art, given the benefit of this disclosure. In certain embodiments, sole assembly 14 may not include an outsole layer separate from midsole 22 but, rather, the outsole comprises a bottom surface of midsole 22 that provides the external traction surface of sole assembly 14.

Figure 2:
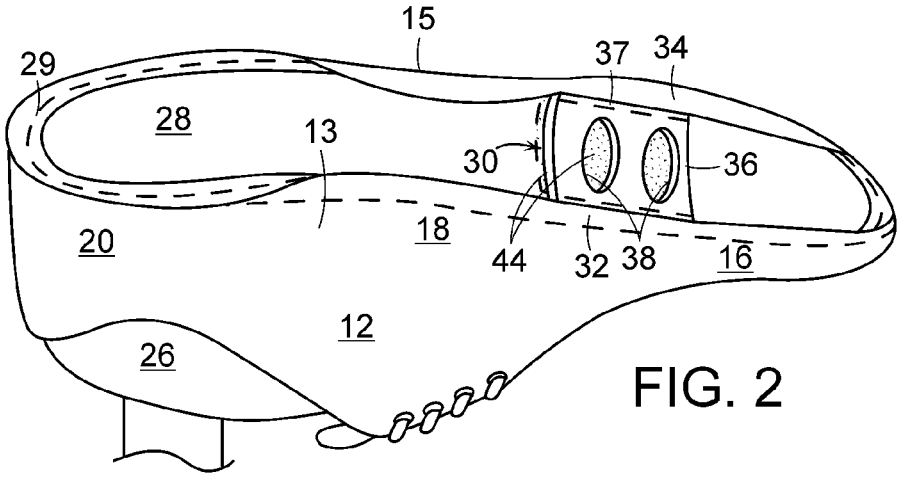
FIG. 2 is a perspective view of the formation of the article of footwear of FIG. 1, showing a pocket positioned beneath the upper, which is mounted on a last in an inverted position.

The manufacture of footwear 10 will be illustrated with respect to FIGS. 2-6. Upper 12 is initially positioned on a last 26 in an inverted position, and a stroebel sock 28 is secured about a peripheral edge thereof to upper 12 with stitching 29. As can be seen in FIG. 2, a pocket 30 is formed beneath upper 12 in a forefoot portion 16 of footwear 10. In the illustrated embodiment, pocket 30 is formed by opposed wings 32, 34 extending downwardly from medial and lateral sides 13, 15, respectively, of upper 12 (wings 32, 34 appear to extend upwardly in FIG. 2 since upper 12 is inverted on last 26 in this view), and a transverse strap 36 extending between wings 32 and 34. First and second ends of strap 36 are secured to wings 32, 34 with stitching 37 or other suitable fastening means. Thus, pocket 30 extends between stroebel sock 28 and strap 36, and is bounded on its sides by wings 32, 34. In certain embodiments, strap 36 may include one or more central apertures 38. As illustrated here, strap 36 includes two central apertures 38. Strap 36 may be formed of a stretchable material. In certain embodiments, strap 36 may be a laminated material, e.g., formed of a layer of nylon tricot, a layer of polyethylene foam and a layer of shiny multi span.

Figure 3:
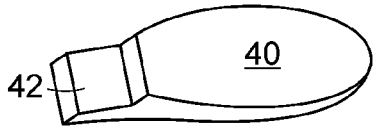
FIG. 3 is a perspective view of a first portion of the midsole of the article of footwear of FIG. 1.
Figure 4:
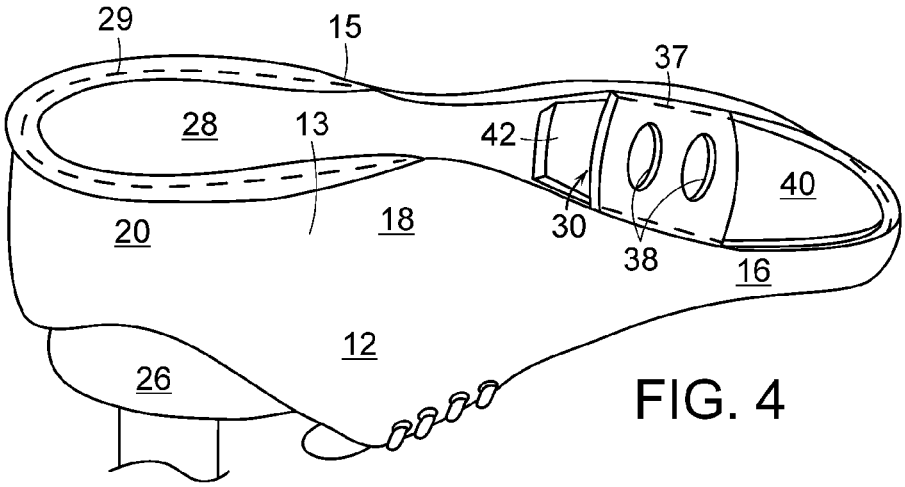
FIG. 4 is a perspective view of the formation of the article of footwear of FIG. 1, shown with the first portion of the midsole of FIG. 3 inserted into the pocket beneath the upper, while the upper is mounted on the last.

A first portion 40 of midsole 22 is illustrated in FIG. 3. In certain embodiments, first portion 40 has a stepped portion 42 at a rear edge thereof. First portion 40 is inserted into pocket 30 while upper 12 is still mounted on last 26, as seen in FIG. 4. It is to be appreciated that in certain embodiments, adhesive 44 may be placed within pocket 30 prior to inserting first portion 40 in pocket 30, to help ensure that first portion 40 is adequately secured within pocket 30, as seen in FIG. 2. Adhesive 44 may, in certain embodiments, be a heat-sensitive adhesive. Thus, first portion 40 can be easily inserted into pocket 30 and after it is positioned properly heat can be applied to activate adhesive 44 and secure first portion 40 in its desired position.

Figure 5:
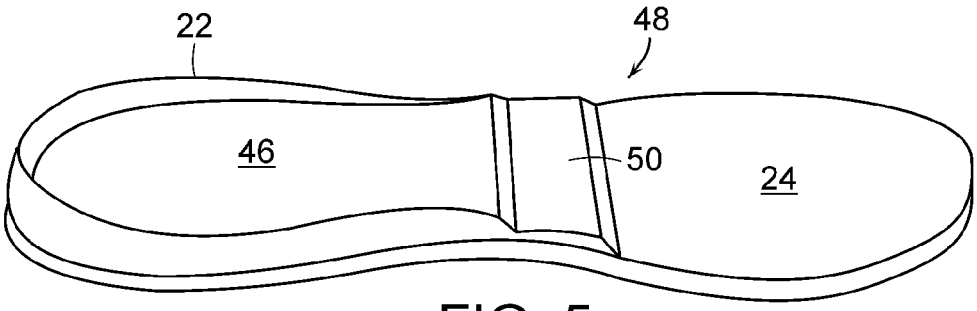
FIG. 5 is a perspective view of an outer sole assembly of the article of footwear of FIG. 1, formed of a second portion of the midsole that is secured to an outsole.
Figure 6:
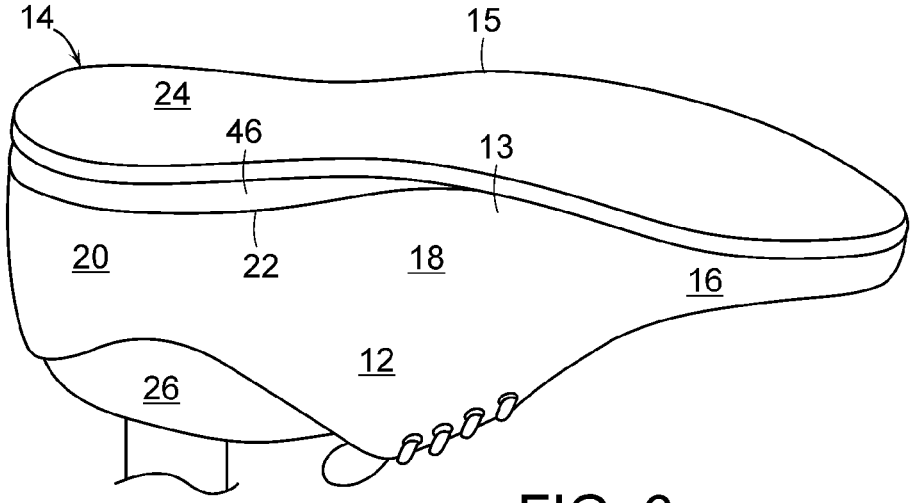
FIG. 6 is a perspective view of the outer sole assembly of FIG. 5, shown being secured to the lower surface of the upper while the upper is mounted on the last.

As seen in FIG. 5, outsole 24 is secured to a second portion 46 of midsole 22 to form an outer sole assembly 48. In certain embodiments, second portion 46 may have a stepped portion 50 at a front edge thereof. Stepped portion 50 is configured to mate with stepped portion 42 of first portion 40 of midsole 20. Outsole 24 may be secured to second portion 46 by an adhesive or other suitable means. Outer sole assembly 48 is then secured to the bottom of upper 12 with adhesive or other suitable means, as illustrated in FIG. 6, thereby completing the assembly of footwear 10. As noted above, stepped portion 50 of second portion 46 of midsole 22 overlies stepped portion 42 of first portion 40 of midsole when outsole assembly is secured to upper 12.

As can be seen in FIGS. 1 and 6, only second portion 46 of midsole 22 is visible from the exterior of footwear 10. First portion 40, being contained within pocket 30 and partially covered by wings 32, 34 of upper 12, is not visible from the exterior of footwear 10. Providing first portion 40 of midsole 22 in pocket 30, separate from second portion 46 can provide improved flexibility for footwear 10.

Figure 7:
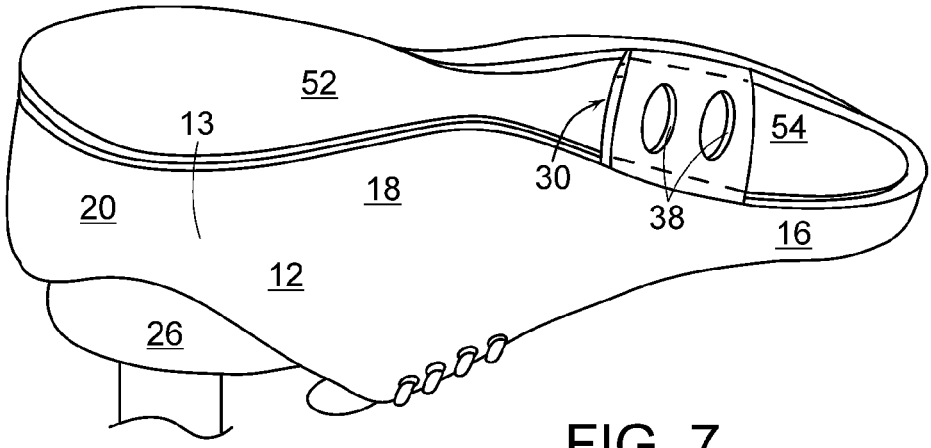
FIG. 7 is a perspective view of the formation of another embodiment of the article of footwear of FIG. 1, shown with a forefoot portion of a midsole portion inserted into the pocket beneath the upper, while the upper is mounted on the last.

In another embodiment, as seen in FIG. 7, a midsole portion 52 of outer sole assembly 48 is positioned beneath upper 12. A forefoot portion 54 of midsole portion 52 is received in pocket 30 with the remainder of midsole portion 52 secured to upper 12. Outsole 24 (not shown here) is then secured to a lower surface of midsole portion 52.

In light of the foregoing disclosure of the invention and description of various embodiments, those skilled in this area of technology will readily understand that various modifications and adaptations can be made without departing from the scope and spirit of the invention. All such modifications and adaptations are intended to be covered by the following claims.

What is claimed is:

1. A method of forming an article of footwear comprising the following steps:

providing an upper having a forefoot portion, a midfoot portion, a heel portion, and a pocket positioned beneath the forefoot portion;

placing the upper on a last;

inserting a first midsole portion into the pocket; and securing an outsole assembly to the upper, the outsole assembly comprising a second midsole portion and an outsole secured to a lower surface of the second midsole portion;

wherein the second midsole portion and the outsole are visible from an exterior of the article of footwear and the first midsole portion is not visible from an exterior of the article of footwear.

2. The method of claim 1, further comprising the step of securing the second midsole portion to an upper surface of the outsole with an adhesive to form the outsole assembly.

3. The method of claim 1, further comprising the step of applying adhesive on an interior of the pocket prior to inserting the first midsole portion in the pocket.

4. The method of claim 3, wherein the adhesive is a heat-sensitive adhesive.

5. The method of claim 1, wherein the outsole assembly is secured to the upper with an adhesive.

6. The method of claim 1, wherein the pocket is formed of a medial wing extending downwardly from the upper, an opposed lateral wing extending downwardly from the upper, and a strap extending between the two wings.

7. The method of claim 6, wherein the strap is formed of a stretchable material.

8. The method of claim 6, wherein the strap includes at least one aperture formed therein.

9. The method of claim 1, further comprising the step of securing the upper to a stroebel sock.

10. The method of claim 1, wherein a rear edge of the first midsole portion includes a stepped portion.

11. The method of claim 10, wherein a front edge of the second midsole portion includes a stepped portion configured to overlay in abutting relationship the stepped portion of the first midsole portion.

12. A method of forming article of footwear formed by the following steps:

placing an upper on a last, the upper having a forefoot portion, a midfoot portion, a heel portion, and a pocket positioned beneath the forefoot portion;

inserting a first midsole portion into the pocket; and securing a outsole assembly to the upper, the outsole assembly comprising a second midsole portion and an outsole secured to a lower surface of the second midsole portion;

wherein the second midsole portion and the outsole are visible from an exterior of the article of footwear and the first midsole portion is not visible from an exterior of the article of footwear.

* * * * *